US011154136B2

(12) United States Patent
Prestwich et al.

(10) Patent No.: US 11,154,136 B2
(45) Date of Patent: Oct. 26, 2021

(54) DOUBLE SHELL SEAT

(71) Applicant: Davis Furniture Industries, Inc., High Point, NC (US)

(72) Inventors: Jonathan Prestwich, London (GB); William R. Easton, High Point, NC (US); Daniel K. Davis, High Point, NC (US)

(73) Assignee: Davis Furniture Industries, Inc., High Point, NC (US)

( * ) Notice: Subject to any disclaimer, the term of this patent is extended or adjusted under 35 U.S.C. 154(b) by 32 days.

(21) Appl. No.: 16/816,804

(22) Filed: Mar. 12, 2020

(65) Prior Publication Data

US 2021/0282555 A1 Sep. 16, 2021

(51) Int. Cl.

| | |
|---|---|
| ***A47C 3/12*** | (2006.01) |
| ***A47C 1/024*** | (2006.01) |
| ***A47C 3/22*** | (2006.01) |
| ***A47C 1/032*** | (2006.01) |

(52) U.S. Cl.

CPC ..... *A47C 3/12* (2013.01); *A47C 1/024* (2013.01); *A47C 1/03266* (2013.01); *A47C 3/22* (2013.01); *A47C 1/0325* (2013.01)

(58) Field of Classification Search

CPC ..... A47C 3/12; A47C 7/405; A47C 1/03294
USPC ..... 297/452.12–452.14, 452.19, 256.1
See application file for complete search history.

(56) References Cited

U.S. PATENT DOCUMENTS

| | | | | |
|---|---|---|---|---|
| 4,840,426 | A | 6/1989 | Vogtherr et al. | 297/300 |
| 5,015,038 | A * | 5/1991 | Mrotz, III | A47C 3/12 297/452.15 |
| 5,052,753 | A | 10/1991 | Buchacz | 297/361 |
| 7,344,192 | B2 * | 3/2008 | Kespohl | B60N 2/2821 297/230.14 |
| 8,061,775 | B2 | 11/2011 | Diffrient | 297/300.1 |
| 10,231,546 | B2 | 3/2019 | Loew et al. | A47C 1/03272 |
| 10,966,527 | B2 * | 4/2021 | Deevers | B29D 99/0092 |
| 2016/0031560 | A1 | 2/2016 | Zheng et al. | |
| 2016/0374471 | A1 * | 12/2016 | Colonello | A47C 3/12 297/326 |

(Continued)

FOREIGN PATENT DOCUMENTS

DE 102018108351 A1 10/2019

OTHER PUBLICATIONS

Leggett & Platt Flyer on LP19 Easy flex (2018).

(Continued)

*Primary Examiner* — Sarah B Mcpartlin

(74) *Attorney, Agent, or Firm* — MacCord Mason PLLC

(57) ABSTRACT

A double shell seat includes a base for resting on a floor, an outer shell supported by the base, and an inner shell movably supported within the outer shell. The inner shell has a seat support, a backrest support, and a hinge between the seat support and the backrest support. The inner shell is movable with respect to the outer shell from an upright condition in which the seat support has a position toward the rear of the outer shell, the backrest support has a position that is relatively vertical, and the hinge is at a first angle, to a reclined condition in which the seat support is forward of its position in the upright condition, the backrest support is less vertical than its position in the upright condition, and the hinge is open at a greater angle than the first angle. The seat is preferably free of coil springs.

17 Claims, 8 Drawing Sheets

(56) References Cited

U.S. PATENT DOCUMENTS

| | | | | |
|---|---|---|---|---|
| 2018/0249835 | A1* | 9/2018 | Loew | A47C 1/03272 |
| 2018/0352961 | A1* | 12/2018 | Deevers | A47C 7/445 |
| 2021/0179274 | A1 | 6/2021 | Lueck et al. | |

OTHER PUBLICATIONS

Steelcase Silq Chair User Guide (2018) Flyer "Understanding and Specifying SILQ418 Series" (Oct. 2019).
Search Report for European Patent Application No. 21161515.8 dated Aug. 12, 2021.

* cited by examiner

DOUBLE SHELL SEAT

BACKGROUND OF THE INVENTION

U.S. Pat. No. 4,840,426 (426 patent) discloses a chair that can alternate between the original and reclined positions. When the backrest tilts backwards, the seat is pushed forward, in what has come to be known as "synchronous motion." A coil spring enclosed in a cylindrical housing is attached to the seat. When the chair is released from the reclined position, the coil spring pulls the seat backwards into the original position. There is a need for a seat or chair that allows synchronous motion without the need for a coil spring.

SUMMARY OF THE INVENTION

The present invention addresses one or more of these needs by providing a double shell seat that includes a base for resting on a floor, an outer shell supported by the base, and an inner shell movably supported within the outer shell. The inner shell has a seat support, a backrest support, and a hinge between the seat support and the backrest support. The inner shell is movable with respect to the outer shell from an upright condition in which the seat support has a position toward the rear of the outer shell, the backrest support has a position that is relatively vertical, and the hinge is at a first angle, to a reclined condition in which the seat support is forward of its position in the upright condition, the backrest support is less vertical than its position in the upright condition, and the hinge is open at a greater angle than the first angle. The seat is preferably free of coil springs.

The inner shell is preferably a single piece of molded plastic, such as polypropylene. The outer shell may also be a single piece of molded plastic that has a seat, back, and arms, with the arms connecting and spanning the seat and back. The outer shell may have the shape of a plastic tub chair.

The outer shell typically has a seat with an upper face, and cooperating ramps and rollers that are on the upper face and the bottom of the seat support are located at positions on the upper face and the bottom of the seat support so that the rollers encounter the ramps, so that a front of the seat support rises as the seat support moves from the upright condition to the reclined condition. The ramps may be on an upper face of the seat, and the inner shell may have the rollers on the bottom of the seat support. The rollers preferably have a barrel shape.

The upper face of the seat of the outer shell may have stops to prevent forward movement of the seat support beyond a completed reclined condition.

The inner shell preferably has flexible edges to avoid injurious finger pinches between the inner and outer shells. The inner shell's flexible edges may be provided in the form of finger-shapes with spaces between the finger-shapes. An upper face of the inner shell may have padding and upholstery.

The outer shell typically has a back with an inner face that has forward pegs, the backrest support of the inner shell has a rear face with vertical slots, and the forward pegs extend into the vertical slots so that the location of the forward pegs in the vertical slots varies as the inner shell moves between the upright and reclined conditions.

Shelves on the upper face of the seat of the outer shell may extend front-to rear, and guides on the bottom face of the seat support may be located at positions so that the guides extend under the shelves to restrain the seat support from separating from the upper face of the outer shell.

Preferably, the inner shell moves from the upright condition to the reclined condition when a person's weight on the inner shell shifts forwardly. The hinge may have resilience that helps restore the inner shell to the upright condition when a person's weight is removed from the inner shell.

BRIEF DESCRIPTION OF THE DRAWINGS

The invention will be better understood by a reading of the Detailed Description of the Examples of the Invention along with a review of the drawings, in which.

DETAILED DESCRIPTION OF EMBODIMENTS

Figure 1:
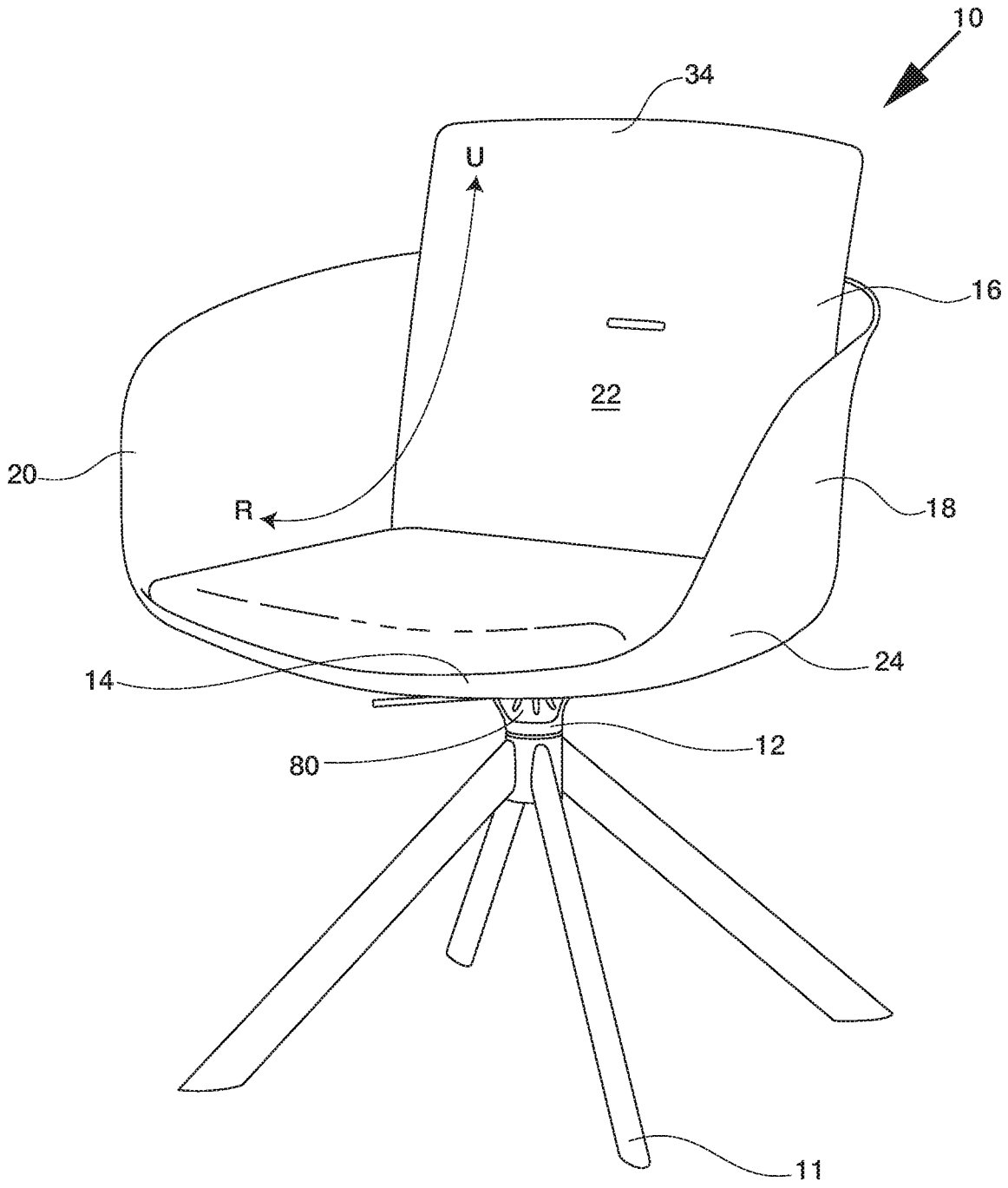
FIG. 1 is a perspective view of a seat in accordance with an embodiment.

FIG. 1 shows the front view of a chair in accordance with an embodiment of the invention. The chair 10 includes a base 11 for resting on a floor. The base can be any conventional configuration, but as shown in FIG. 1 is a 4 legged version. The legs come together to support a post 12. Above the post 12 is a seat 14, a back rest 16, and left and right armrests 18 and 20, respectively. In preferred embodiments, the post 12 is provided with a conventional gas cylinder 80 to which gas can be admitted or released through a valve. Other seat base configurations can be used.

Figure 9:
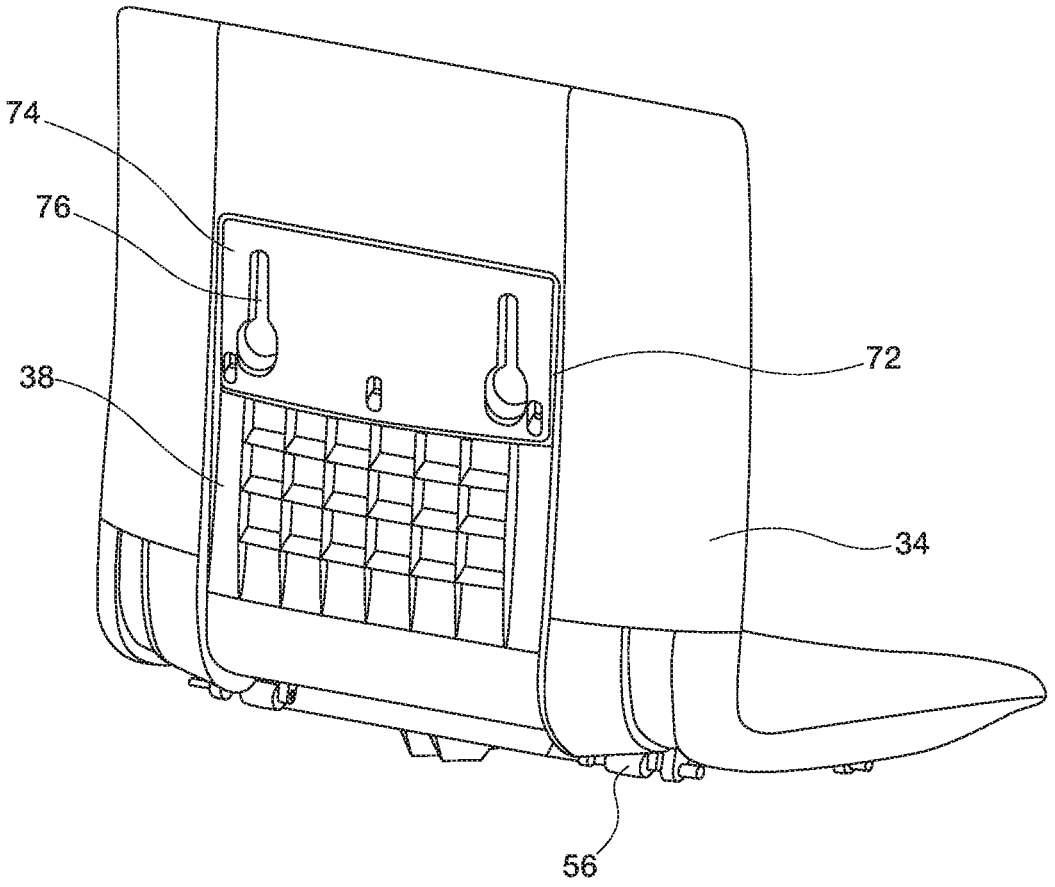
FIG. 9 is a perspective view of the outside face of the inner shell, with upholstery, of the embodiment of FIG. 1.
Figure 10:
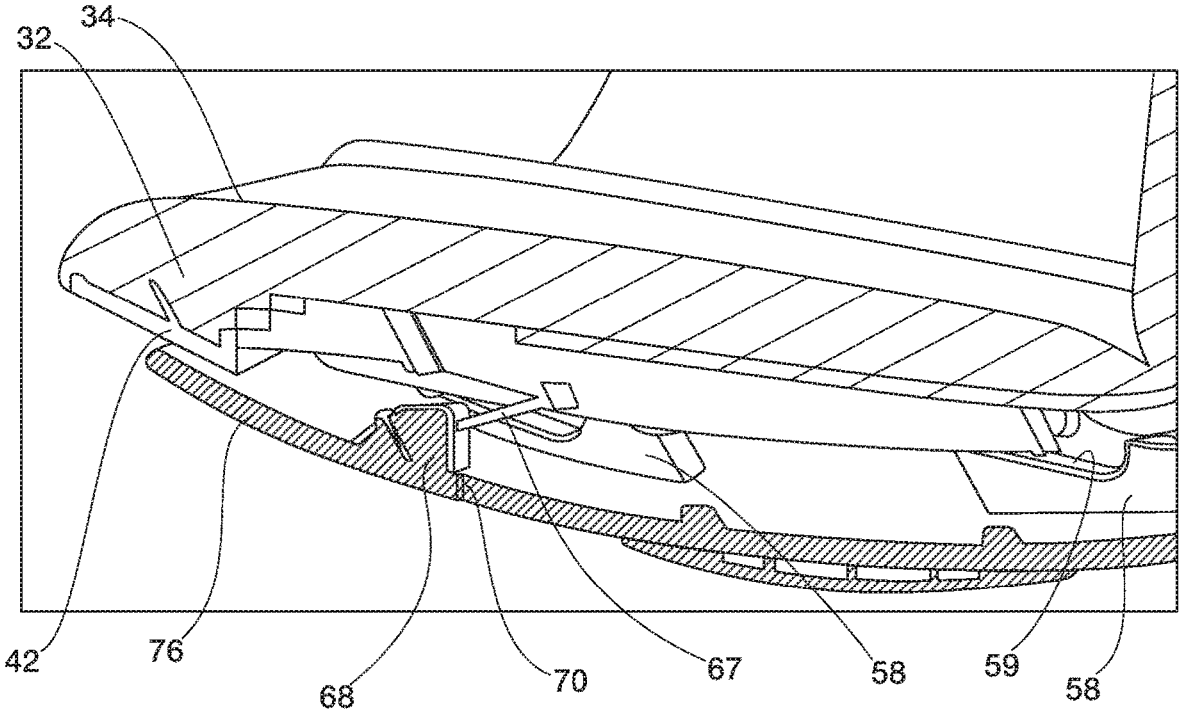
FIG. 10 is a sectional view through the seat portions of the assembled inner and outer shells.

FIG. 1 shows that above the base 11, the chair is assembled as an inner shell 22 and an outer shell 24. Outer shell 24 includes a seat 26, back 28, and arms 30, the arms connecting and spanning the seat and back. The outer shell is preferably a single piece of molded plastic, but it could be made of other materials and could be an assembly of subcomponents. The outer shell should be relatively rigid, however, as it primarily defines the shape of the chair for the user of the chair. As seen in FIGS. 1, 9, and 10 the inner shell has padding 32 and an upholstered cover 34, which can be fabric, leather, or other appropriate material.

Figure 2:
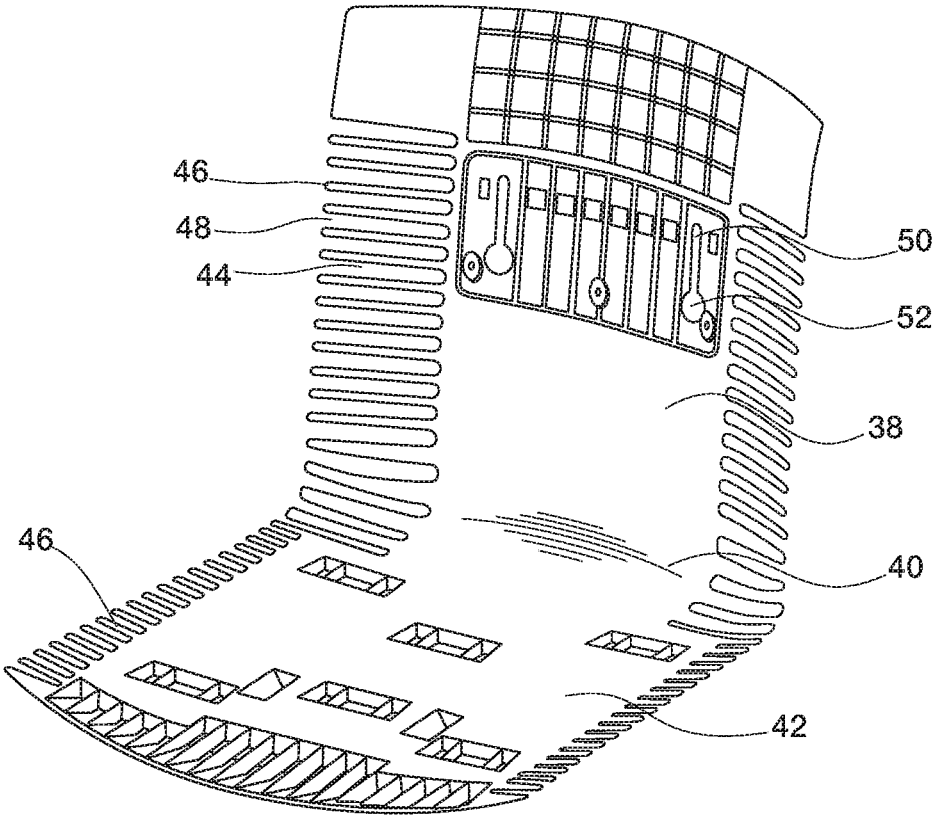
FIG. 2 is a perspective view of the inside face of the inner shell of the embodiment of FIG. 1.
Figure 3:
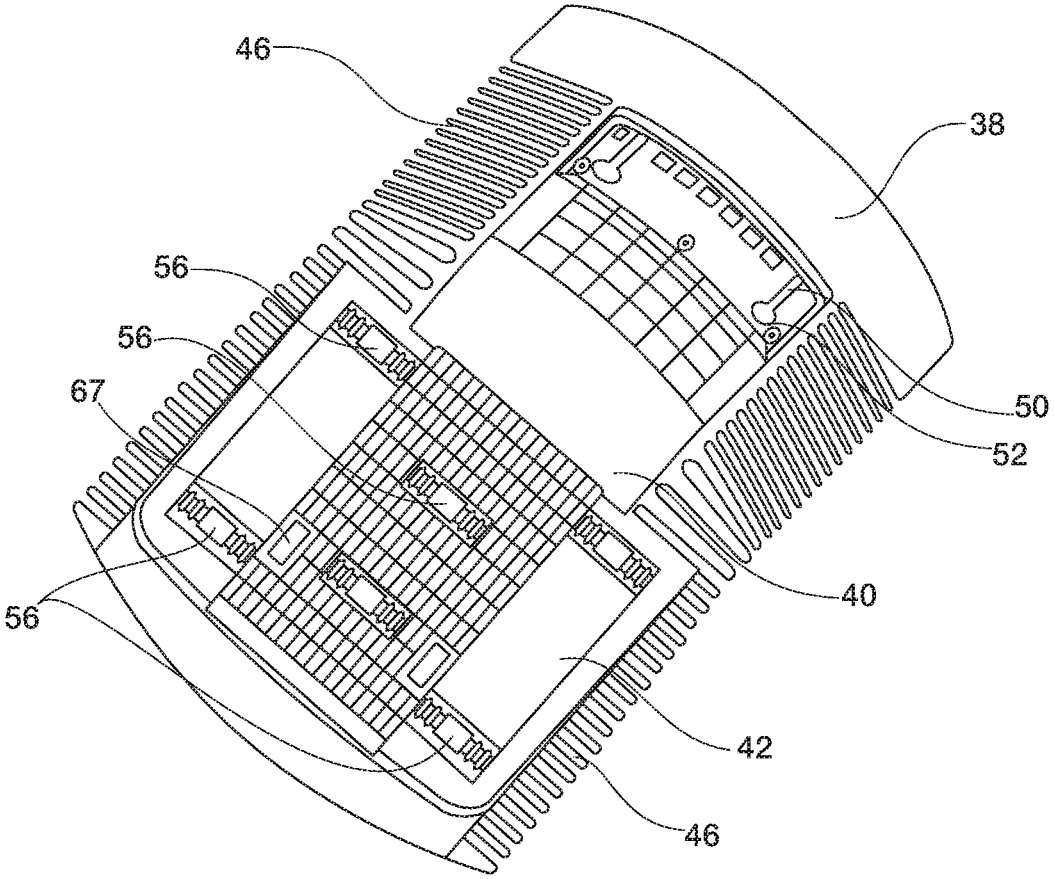
FIG. 3 is a perspective view of the outside face of the inner shell of the embodiment of FIG. 1.

FIGS. 2 and 3 are perspective views of the inside and outside faces, respectively, of the inner shell 22 of the embodiment of FIG. 1. The inner shell is preferably made of a single piece of molded plastic, such as polypropylene. The inner shell has a seat support 42, a backrest support 38, and a hinge 40 between the seat support and the backrest support. The hinge has resilience that gives it properties that restore the inner shell to the upright condition when a person's weight is removed from the inner shell.

The inner shell 22 is movable with respect to the outer shell 24 to provide the chair's user with the option of an upright condition or a reclined condition. The relative movement between the upright condition and the reclined condition is shown by the arrows U-R in FIG. 1. Normally, when unoccupied by a user or other weight, the inner shell is in the upright condition. When the backrest reclines the backrest slides downwards and the seat moves forwards to increase the comfort and give a more ergonomic position. The user's positioning in the chair can drive the back 38 of the inner shell to move down and the seat support 42 of the inner shell to move forward to the reclined condition, which causes the angle of the hinge 40 between the back of the inner shell and the seat of the inner shell to increase. When the sitter moves forward, the person's weight on the seat returns the seat and therefore backrest to the upright condition. The hinge 40 of the inner shell 22 may have sufficient resilience to return to the upright condition when the user's weight or other force no longer forces the inner shell into the reclined condition.

As shown in FIGS. 2 and 3, the inner shell 22 has flexible left and right edges 44 in the form of finger-shapes 46 with spaces 48 between the finger-shapes. The flexible edges reduce the likelihood that user's fingers or other item may get injured by being pinched between the edge of the inner shell and the outer shell. They also allow for the inner shell to bear onto the outer shell, even as the relative height of the inner shell above the outer shell varies as the inner shell transitions between the upright and the reclined conditions.

FIGS. 2 and 3 show that the backrest support 38 has two laterally spaced vertical slots 50, with a widened bottom 52. These slots 50 are configured and positioned to receive pegs 54 (see FIGS. 4 and 5) on the inside face of the back 28 of the outer shell. The pegs 54 extend into the vertical slots 50 so that the location of the pegs in the vertical slots varies as the inner shell moves between the upright and reclined conditions.

Figure 4:
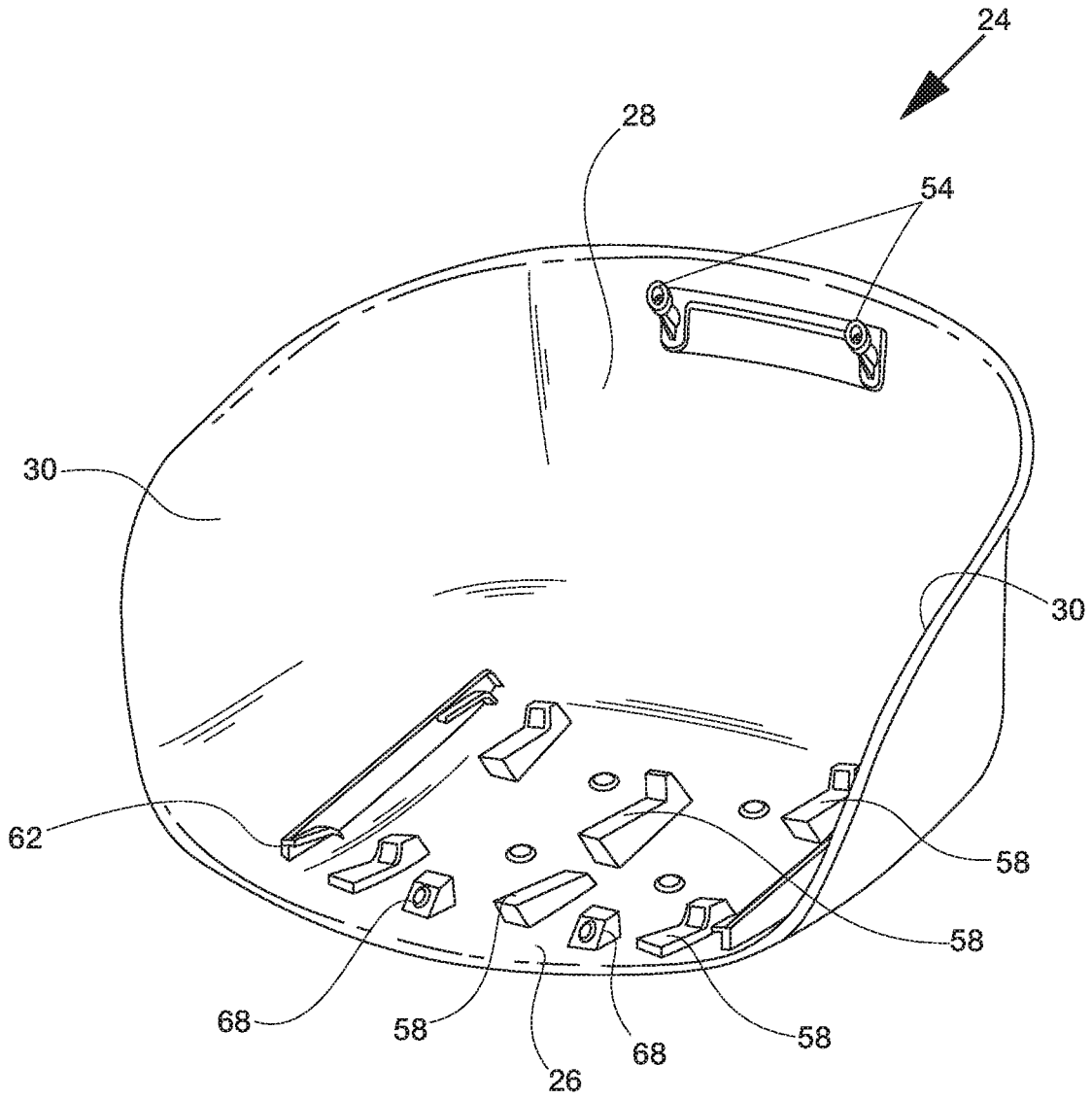
FIG. 4 is a perspective view of the inside face of the outer shell of the embodiment of FIG. 1.
Figure 5:
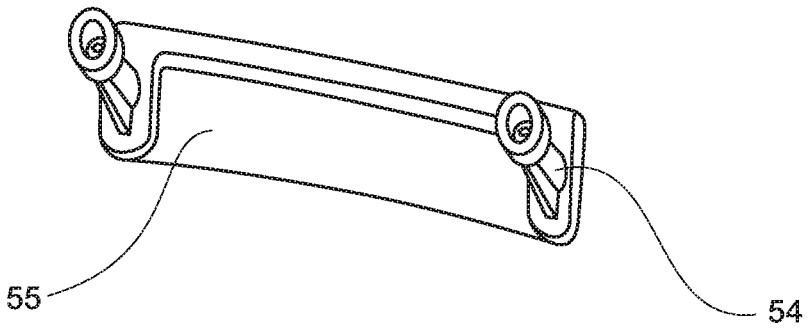
FIG. 5 is an enlarged view of a portion of the inside face of the back of the outer shell of the embodiment of FIG. 1.
Figure 6:
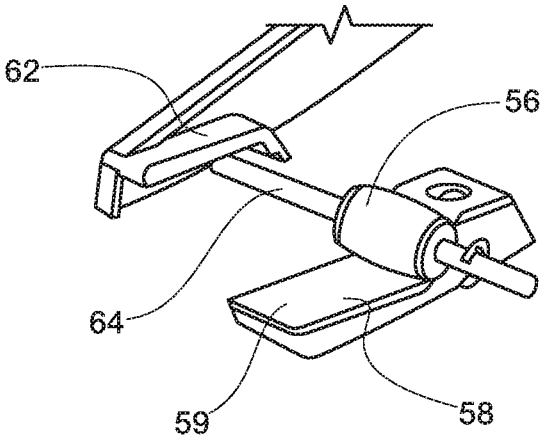
FIG. 6 is an enlarged view of a portion of the inside face of the seat of the outer shell of the embodiment of FIG. 1.

The seat support 42 of the inner shell has rollers 56 that are exposed at the bottom face of the seat support. FIG. 3 shows the location of six rollers 56. The rollers are configured and positioned to contact and ride on ramps 58 on the top face of the seat 26 of the outer shell, as seen in FIGS. 4 and 6. As the seat transitions from the upright condition to the reclined condition, the rollers 56 ride up the ramps 58 on the upper face of the seat of the outer shell, so the front of the seat support rises. The rollers move about 40 millimeters (1.6 inch) in one embodiment. The top face 59 of ramps and the roller 56 may be made of POM nylon, which has a lubricity to minimize noise or squeaks. Pegs 54 and their mount 55 may also be made of POM nylon to reduce noise. The rollers preferably have a barrel shape, with the center of the roller having a larger circumference than the ends. The barrel shape reduces the contact area with the ramps, which can also reduce noise.

No coil spring is needed in the chair. Instead, the seat shell has a living hinge 40 between the seat support 42 and backrest support 38 in the form of a resilient plastic connection that gives resistance when being opened. However, the main resistance comes from the fact that the seat is on an inclined ramp so when the backrest moves, the seat raises the weight of the sitter and thus gives an appropriate resistance to the backrest in accordance to the sitter's weight.

When the sitter starts to shift his weight forward (as in arising from the seat), the seat support 42 travels back down the inclined ramp, pushing the backrest support 38 upwards and into an upright position. The backrest is proportionally by weight helping the sitter to move to an upright position by the seat support travelling down the ramps, as an automatic mechanism. As the seat support moves forward, it also moves a little bit upwards and thus lifting the sitter to create this automatic mechanism.

While the embodiment shown has the ramps on the top of the seat of the outer shell, and the rollers on the bottom of the seat support of the inner shell, it is within the scope of the invention for the rollers to be on the outer shell and the ramps on the inner shell.

FIGS. 4 and 6 show shelves 62 on the upper face of the seat 26 of the outer shell that extend front-to rear. The axle 64 of one of the rollers 56 can be seen in FIG. 6 as extending under the shelf 62 like a guide to restrain the seat support from separating from the upper face of the outer shell, but if the seat support moves forward sufficiently, the guides or axles can be lifted past the shelves. As seen in FIG. 4, the shelves and axles are located at positions so that axles extend under the shelves on both the left and right sides of the outer shell.

Figure 7:
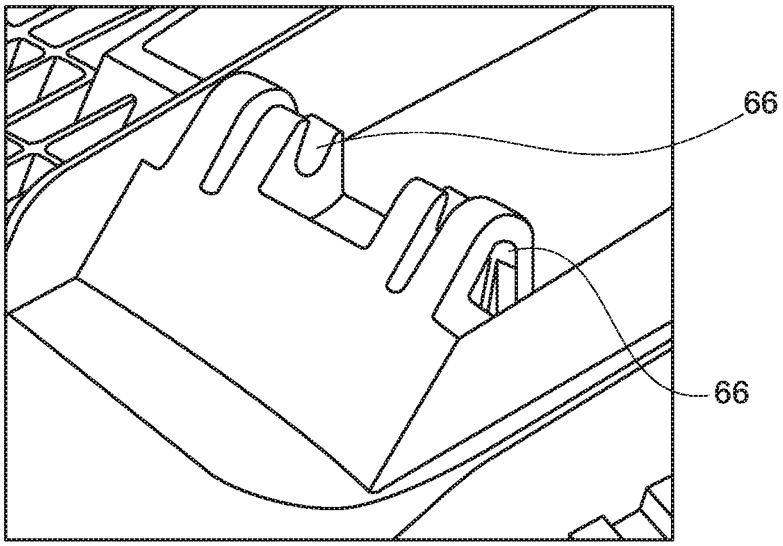
FIG. 7 is an enlarged view of a portion of the bottom face of the inner shell of the embodiment of FIG. 1.
Figure 8:
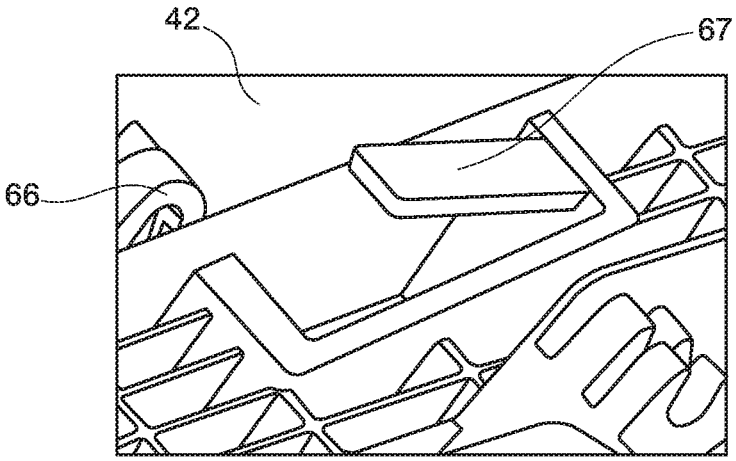
FIG. 8 is an enlarged view of a portion of the bottom face of the inner shell of the embodiment of FIG. 1.

FIGS. 7 and 8 are enlarged images of features on the bottom face of the seat support 42 of the inner shell 22. FIG. 7 shows a bearing 66 to receive and retain an axle 64 of a roller.

FIGS. 3 and 8 show that the bottom face of the seat support 42 has protrusions 67. Protrusions 67 are located so they come into contact with stops 68 on the upper face of the seat of the outer shell at eh completion of a transition to the reclined condition, preventing movement of seat support beyond the completed reclined condition, as seen in FIG. 10.

Small holes 70 formed in the outer shell's seat 26 just behind the stops 68 enable a dowel to be inserted to compress the protrusion 67 so it can clear the top of the stop and allow further forward movement of the seat support 42, so the axles 64 are no longer below the shelves 62. This permits removal of the inner shell from the outer shell in the unusual event that the inner shell needs repair or replacement.

FIG. 9 shows arear view of the inner shell once the padding 32 and upholstery 34 have been put in place. The padding can be installed by masking the locations of the rollers 56 and the vertical slots 50 to shield them, followed by mounting the inner shell 22 in a mold and injecting foam into the mold to form the padding. The foam padding can be wrapped with the upholstery cover 34, and the cover 34 can be held in place by staples 72 or the like. A plate 74 with slots 76 can be added to align it slots with the slots 50.

The inner shell can be attached to the outer shell by positioning the axles 64 under the shelves 62 to locate the seat support 42 and then inserting the pegs 54 into the slots 76, 50 to hang the back 38 on the back 28.

Certain modifications and improvements will occur to those skilled in the art upon reading the foregoing description. It should be understood that all such modifications and improvements have been omitted for the sake of conciseness and readability but are properly within the scope of the following claims

What is claimed is:

1. A double shell seat comprising a base for resting on a floor, an outer shell supported by the base, and an inner shell movably supported within the outer shell, the inner shell having a seat support, a backrest support, and a hinge between the seat support and the backrest support, the inner shell being movable with respect to the outer shell from an upright condition in which the seat support has a position toward a rear of the outer shell, the backrest support has a position that is relatively vertical, and the hinge is at a first angle, to a reclined condition in which the seat support is forward of its position in the upright condition, the backrest support is less vertical than its position in the upright condition, and the hinge is open at a greater angle than the first angle, wherein the outer shell has a seat with ramps on an upper face of the seat, and the inner shell has rollers on a bottom of the seat support at positions of the seat support so that the rollers encounter the ramps on the upper face of the seat of the outer shell, so the seat support rises as it moves from the upright condition to the reclined condition.

2. A double shell seat as claimed in claim 1 wherein the inner shell is a single piece of molded plastic.

3. A double shell seat as claimed in claim 1 wherein the inner shell is a single piece of molded polypropylene.

4. A double shell seat as claimed in claim 1 wherein the outer shell is a single piece of molded plastic that has a seat, back, and arms, the arms connecting and spanning the seat and back.

5. A double shell seat as claimed in claim 1 wherein the outer shell is shaped like a plastic tub chair.

6. A double shell seat as claimed in claim 1 wherein the rollers have a barrel shape.

7. A double shell seat as claimed in claim 1 wherein the upper face of the seat of the outer shell has stops to prevent forward movement of the seat support beyond a completed reclined condition.

8. A double shell seat as claimed in claim 1 wherein the inner shell has flexible edges.

9. A double shell seat as claimed in claim 8 wherein the inner shell's flexible edges are provided in the form of finger-shapes with spaces between the finger-shapes.

10. A double shell seat as claimed in claim 1 wherein an upper face of the inner shell has padding and upholstery.

11. A double shell seat as claimed in claim 1 wherein the outer shell has a back with an inner face that has forward pegs, the backrest support of the inner shell has a rear face with vertical slots, and the forward pegs extend into the vertical slots so that the location of the forward pegs in the vertical slots varies as the inner shell moves between the upright and reclined conditions.

12. A double shell seat as claimed in claim 1 wherein the outer shell has a seat with an upper face and shelves on the seat extend front-to rear and guides on a bottom face of the seat support are located at positions so that the guides extend under the shelves to restrain the seat support from separating from the upper face of the outer shell.

13. A double shell seat as claimed in claim 1 wherein the inner shell moves from the upright condition to the reclined condition when a person's weight on the inner shell shifts forwardly.

14. A double shell seat as claimed in claim 1 wherein the hinge has resilience that helps restore the inner shell to the upright condition when a person's weight is removed from the inner shell.

15. A double shell seat as claimed in claim 1 that is free of coil springs.

16. A double shell seat comprising a base for resting on a floor, an outer shell supported by the base, and an inner shell movably supported within the outer shell, the inner shell having a seat support, a backrest support, and a hinge between the seat support and the backrest support, the inner shell being movable with respect to the outer shell from an upright condition in which the seat support has a position toward a rear of the outer shell, the backrest support has a position that is relatively vertical, and the hinge is at a first angle, to a reclined condition in which the seat support is forward of its position in the upright condition, the backrest support is less vertical than its position in the upright condition, and the hinge is open at a greater angle than the first angle, wherein the outer shell has a seat with an upper face, and cooperating ramps and rollers that are on the upper face and a bottom of the seat support are located at positions on the upper face and the bottom of the seat support so that the rollers encounter the ramps, whereby a front of the seat support rises as the seat support moves from the upright condition to the reclined condition.

17. A double shell seat comprising a base for resting on a floor, an outer shell supported by the base, the outer shell being a single piece of molded plastic that has a seat, back, and arms, the arms connecting and spanning the seat and back, and an inner shell made of a single piece of molded plastic movably supported within the outer shell, the inner shell having a seat support, a backrest support, and a hinge between the seat support and the backrest support, wherein the inner shell has flexible edges in the form of finger-shapes with spaces between the finger-shapes, the inner shell being movable with respect to the outer shell from an upright condition in which the seat support has a position toward a rear of the outer shell, the backrest support has a position that is relatively vertical, and the hinge is at a first angle, to a reclined condition in which the seat support is forward of its position in the upright condition, the backrest support is less vertical than its position in the upright condition, and the hinge is open at a greater angle than the first angle, the inner shell moving from the upright condition to the reclined condition when a person's weight on the inner shell shifts forwardly, and the hinge having resilience that helps restore the inner shell to the upright condition when a person's weight is removed from the inner shell, wherein the outer shell has a seat with ramps on an upper face of the seat, and the inner shell has rollers on a bottom of the seat support at positions of the seat support so that the rollers encounter the ramps on the upper face of the seat of the outer shell, so the seat support rises as it moves from the upright condition to the reclined condition, wherein shelves on the upper face of the seat of the outer shell extend front-to rear and guides on the bottom face of the seat support are located at positions so that the guides extend under the shelves to restrain the seat support from separating from the upper face of the outer shell, wherein the upper face of the seat of the outer shell has stops to prevent forward movement of the seat support beyond a completed reclined condition, and wherein the outer shell has a back with an inner face that has forward pegs, the backrest support of the inner shell has a rear face with vertical slots, and the forward pegs extend into the vertical slots so that the location of the forward pegs in the vertical slots varies as the inner shell moves between the upright and reclined conditions.

* * * * *